United States Patent [19]

Brackman et al.

[11] Patent Number: 5,071,178

[45] Date of Patent: Dec. 10, 1991

[54] MOTOR-VEHICLE DOOR LATCH

[75] Inventors: Horst Brackman, Velbert; Lothar Brandes, Helmstedt, both of Fed. Rep. of Germany

[73] Assignee: Kiekert GmbH & Co. Kommanditgesellschaft, Heiligenhaus, Fed. Rep. of Germany

[21] Appl. No.: 560,607

[22] Filed: Jul. 31, 1990

[30] Foreign Application Priority Data

Aug. 19, 1989 [DE] Fed. Rep. of Germany ..... 3927445

[51] Int. Cl.[5] ..... E05C 3/26

[52] U.S. Cl. ..... 292/216

[58] Field of Search ..... 292/216, 198, DIG. 23

[56] References Cited

U.S. PATENT DOCUMENTS

| | | | |
|---|---|---|---|
| 3,334,935 | 7/1965 | Eddy | 292/216 |
| 3,592,496 | 7/1971 | Ploughman | 292/216 |
| 3,773,368 | 11/1973 | Atwood et al. | 292/216 |
| 4,165,112 | 8/1979 | Kleefeldt | 292/216 |
| 4,203,621 | 5/1980 | Noel et al. | 292/216 |
| 4,783,102 | 11/1988 | Bernard | 292/216 |
| 4,886,307 | 12/1989 | Ruckert | 292/216 |

*Primary Examiner*—Gary L. Smith
*Assistant Examiner*—Darnell Boucher
*Attorney, Agent, or Firm*—Herbert Dubno; Andrew Wilford

[57] ABSTRACT

A motor-vehicle door latch for mounting on a door closable inward against a body part has a latch element fixed on the part and displaceable into and out of a latch housing and a latch fork pivotal on the housing. This fork is pivoted into a closed position on inward displacement of the latch element into the housing and the latch fork has an inwardly directed face bearing inward against the latch element in the closed position with the latch element in the housing. A latch pawl is pivotally engageable with the fork in a holding position to retain same in the closed position. The latch pawl can be pivoted out of contact with the fork to release same and allow the door to open. A blocking member in the housing has an outwardly directed face and is displaceable in the housing between a blocking position with the blocking face confronting and relatively closely juxtaposed with the fork face and an unblocking position with the blocking face spaced more remotely from the fork face. A link between the latch pawl and the blocking member displaces the blocking member into the blocking position and pressed the blocking-member face outward against the latch element in the closed position of the latch pawl. Thus the latch element is trapped between the faces. The blocking member also moves the blocking member into the unblocking position when the latch pawl is not in the closed position to permit overtravel of the fork.

4 Claims, 2 Drawing Sheets

MOTOR-VEHICLE DOOR LATCH

FIELD OF THE INVENTION

The present invention relates to a door latch. More particularly this invention concerns such a latch used on a motor-vehicle door.

BACKGROUND OF THE INVENTION

A standard motor-vehicle door latch has a latch housing mounted on a door edge, a latch fork pivotal on the housing and latchingly engageable around a latch element mounted on the doorpost or body frame, and a latch pawl mounted on the housing for retaining the fork around the element or releasing it to free the element. This pawl can be moved into the fork-freeing position by inside and outside door handles, and the outside handle at least can be decoupled from the pawl by locking mechanisms inside and outside the door.

The latch element can be a bolt, wedge, or the like and a bumper is frequently provided on the fork or latch element so that the latch element can overtravel somewhat when the door, which can be a hood or trunk lid, is closed, leaving the bumper compressed in the latch mechanism to hold everything tight against rattling.

The overtravel of the door on closing is necessary in order to ensure that it remains tightly closed and to allow the pawl to swing into position. The bumper typically serves to allow the door to spring back somewhat and often works with or is in fact formed at least partially by elastomeric seals provided around the rim of the door so as to provide, in effect, an elastomeric seat in which the door sits when closed. The exact position of the door when closed, however, is typically established in the latch by an abutment which has some degree of adjustability so that the closed position can be set exactly.

Nonetheless the considerable mass of the door, the dynamic and changing forces it is subjected to, and other factors lead to a less than perfect seating and corresponding rattling with time. When the bumper and door seal are insufficiently compressed the door is certain to rattle, and when excessively compressed it may be difficult to latch the door, or unwanted metal-to-metal contact can be created for another noise problem.

OBJECTS OF THE INVENTION

It is therefore an object of the present invention to provide an improved motor-vehicle door latch.

Another object is the provision of such an improved motor-vehicle door latch which overcomes the above-given disadvantages, that is which closes with overtravel but which always seats solidly in the same position.

SUMMARY OF THE INVENTION

A motor-vehicle door latch for mounting on a door closable inward against a body part has a latch element fixed on the part and displaceable inward into and outward out of a latch housing and a latch fork pivotal on the housing between a closed position and an open position and pivotal inward somewhat past the closed position. This fork is pivoted into the closed position on inward displacement of the latch element into the housing and the latch fork has an inwardly directed face bearing inward against the latch element in the closed position with the latch element in the housing. A latch pawl is pivotally engageable with the fork in a holding position to retain same in the closed position. An actuator is coupled with the latch pawl for pivoting same into the freeing position out of contact with the fork for releasing same and allowing the door to open. A blocking member in the housing has an outwardly directed face and is displaceable in the housing between a blocking position with the blocking face confronting and relatively closely juxtaposed with the fork face and an unblocking position with the blocking face spaced more remotely from the fork face. A link between the latch pawl and the blocking member displaces the blocking member into the blocking position and presses the blocking-member face outward against the latch element in the closed position of the latch pawl. Thus the latch element is trapped between the faces. The latch pawl also moves the blocking member into the unblocking position when the latch pawl is not in the closed position to permit overtravel of the fork.

Thus there is nothing to impede the inward overtravel needed for solid latching of the door, but once the door is closed the blocking member moves into position to prevent such inward movement. Similarly when the door is to open the blocking member is moved out of engagement with the door, in effect releasing the outward clamping action pushing the latch element against the fork, thereby making it easier for this fork to be released by the pawl.

According to features of this invention the blocking member is pivotal on the housing between the blocking and unblocking positions. It is a lever having a blocking arm formed with the blocking surface and an actuating arm connected via the link to the latch pawl. Furthermore the link is an arm formed on the latch pawl and engageable with the actuating arm of the blocking member. A spring urges the blocking member into the blocking position. This spring is weaker then the spring that urges the pawl into the holding position.

DESCRIPTION OF THE DRAWING

The above and other objects, features, and advantages will become more readily apparent from the following, reference being made to the accompanying drawing in which.

SPECIFIC DESCRIPTION

Figure 2:
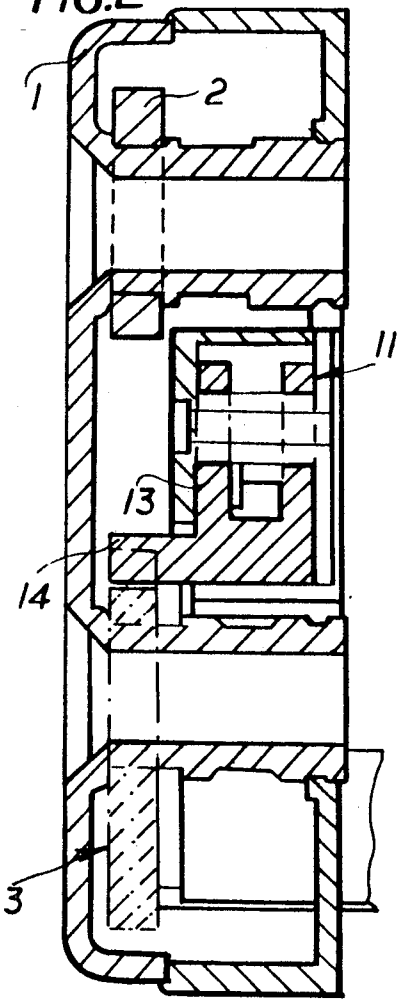
FIG. 2 is a section taken along line II—II of FIG. 1.
Figure 1:
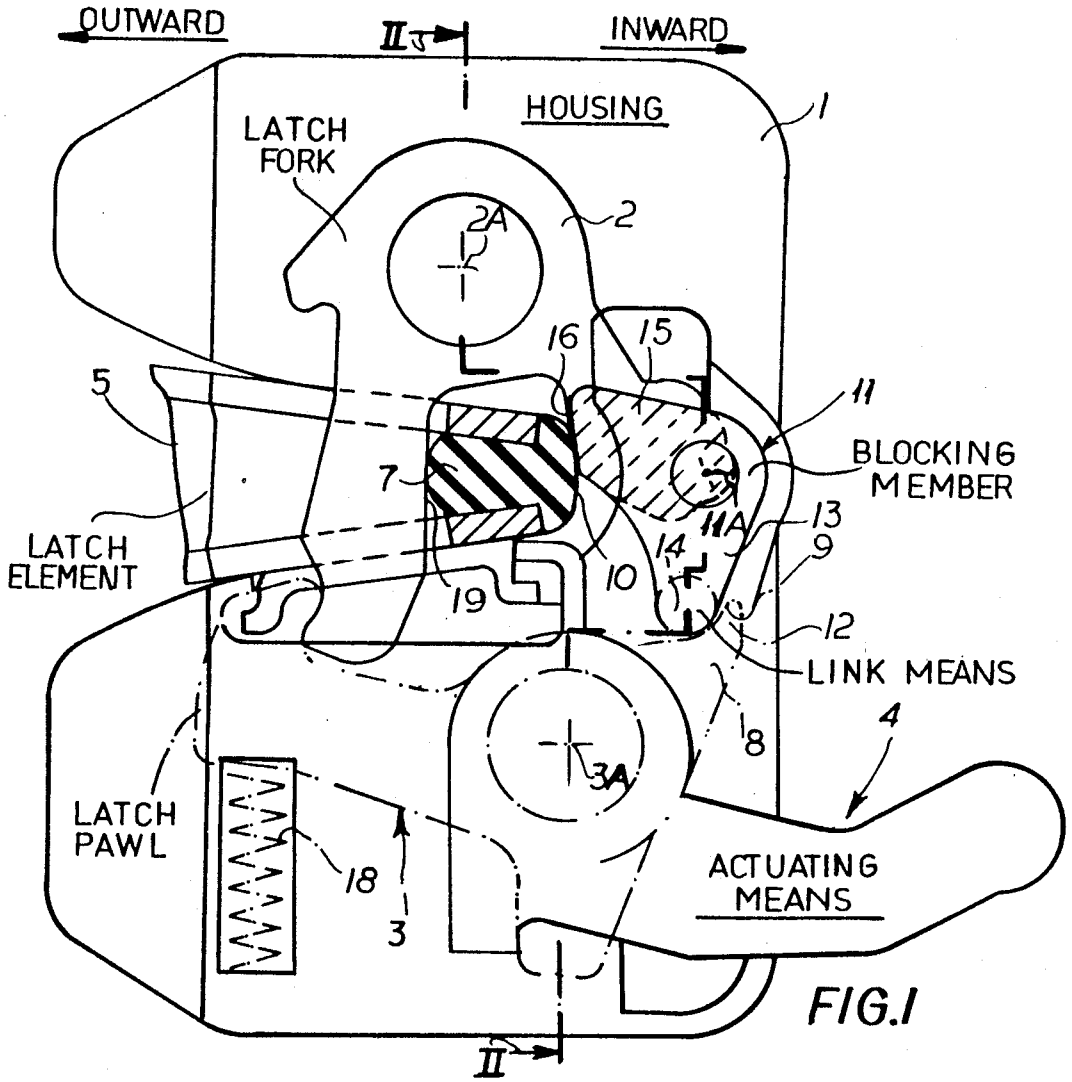
FIG. 1 is a vertical section through the latch according to this invention in the closed position.

As seen in FIGS. 1 and 2 a latch according to this invention has a housing 1 normally fixed to a door edge and provided with a latch fork 2 pivotal about a horizontal axis 2A normally parallel to the direction of vehicle travel. A latch pawl 3 pivotal on this housing 1 about a parallel axis 3A can hook and retain the fork 2 in the closed position of FIG. 1, or can release it to swing clockwise about its axis 2A outward (to the left in FIGS. 1, 3, and 4) when in the freeing position shown in FIG. 3. An operating lever 4 coaxially pivoted with the pawl 3 can be operated by inside and outside door handles to pivot this pawl 3 between the FIG. 1 holding position and the FIG. 3 freeing position. A relatively strong spring 18 normally urges the pawl 3 into the holding position.

A latch element 5 formed here as an eye with a built-in elastomeric bumper 7 can engage in the housing I between the legs of the fork 2 to be retained in the latch in the manner well known in the art. When the door carrying the element 5 is closed, this element 5 pushes the fork 2 inward by rotating it counterclockwise so that it moves slightly inward past the illustrated closed position as indicated by overtravel 6 in FIG. 4. This overtravel 6 makes it possible for the latch pawl 3 to snap up around it and ensures that the vehicle door is closed tightly. In the closed position an inwardly directed surface 19 of the outer leg of the fork 2 bears inward (toward the right in FIGS. 1, 3, and 4) against the bumper 7 of the element 5.

According to this invention a blocking lever 11 pivotal about an axis 11A parallel to the axes 2A and 3A on the housing 1 has one arm 13 carrying an actuating member 14 operable by a surface 9 of an extension 12 of an arm 8 of the pawl 3 and another arm 15 formed with a blocking surface 16 that can be moved by pivoting of this lever 11 between an unblocking position closely confronting the surface 19 and a blocking position spaced somewhat outward therefrom. A relatively weak spring illustrated schematically at 17 urges the lever 11 counterclockwise into the blocking position shown in FIG. 1.

Figure 4:
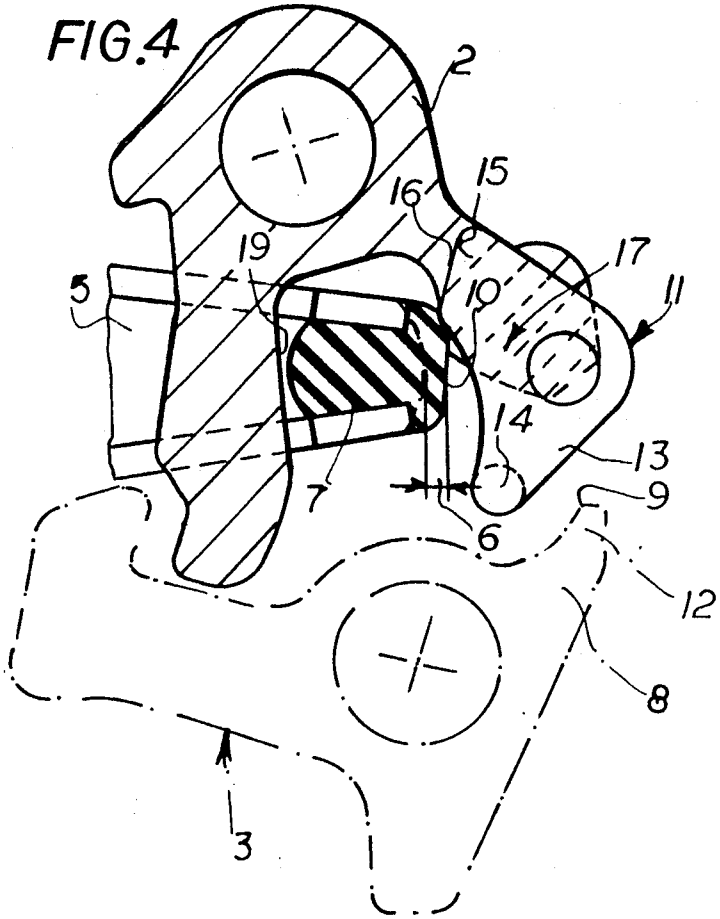
FIG. 4 is a view like FIG. 3 but with the latch fork moved inward (to the right in FIGS. 1, 3, and 4) in overtravel somewhat past its closed position.
Figure 3:
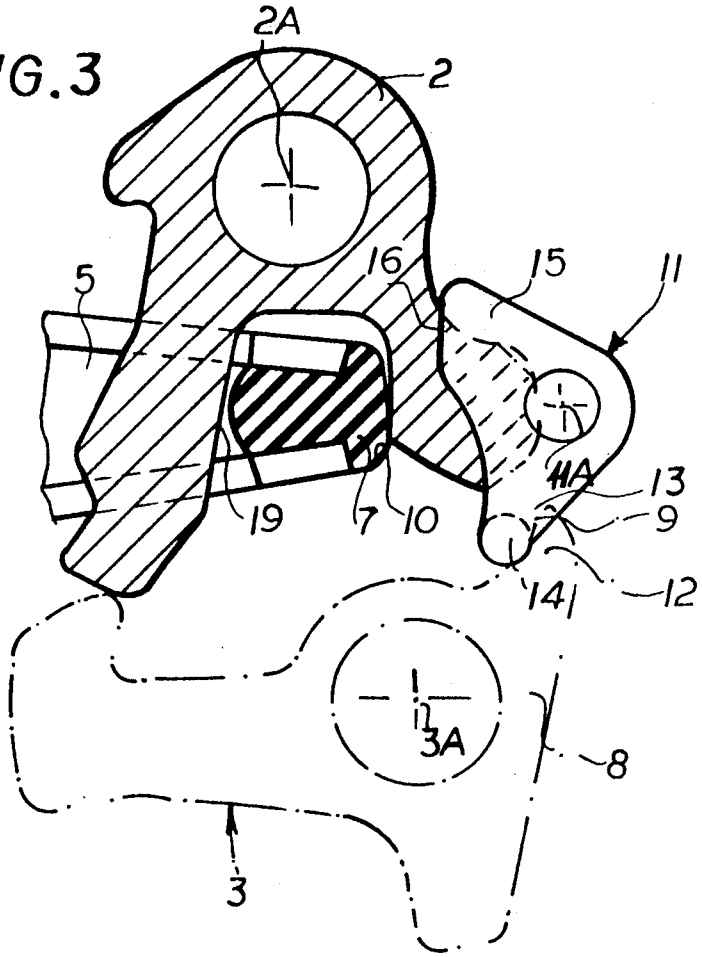
FIG. 3 is a view of details of the latch with the blocking lever in the unblocking position and the latch fork between the closed and open positions.

As seen in FIG. 3 on closing of the door the fork 2 cams out the pawl 3, pivoting it counterclockwise. This action pushes the surface 9 against the arm 13 and allows the lever 11 to pivot clockwise so that the surface 16 is pulled back and does not interfere significantly with movement of the element 5. During overtravel of the fork 2 inward as illustrated in FIG. 4 the pawl 3 can snap up in front of the fork 2 and the bumper 7 engages inward against the surface 16. In this FIG. 4 position the surface 9 has released the arm 13.

From the FIG. 4 position the spring 17 forces the surface 16 into operative engagement with the inner face of the element 5 via its bumper and the outer face of this element 5 is brought into operative engagement via its bumper 7 with the inner face 19 of the outer leg of the fork 2. This outward pushing of the element 5 is normally assisted by the compression of the unillustrated elastomeric seal running around the vehicle door opening. In addition the axis 11A of the lever 11 is in line with the points of contact between the element 5 and the surfaces 19 and 16 so that the surface 16 has a mechanical advantage to exert a not inconsiderable outward clamping force against the element 5.

For opening of the door the lever 4 is pivoted counterclockwise to entrain the lever 3, thereby pulling it out of its holding position retaining the fork 2 against outward pivoting, and simultaneously pivoting the member 11 up into the unblocking position. This frees the element 5 so the door can open. The fact that the lever 11 is no longer clamping the element 5 against the fork 2 relieves some of the force effective on the pawl 3 to make pulling it into the freeing position somewhat easier than on a prior-art latch.

We claim:

1. A motor-vehicle door latch for mounting on a door closable in an inward direction against a body part, the door latch comprising:

a housing fixed on the door;

a latch element fixed on the part and displaceable in the inward direction into and in an opposite outward direction out of the housing;

a latch fork pivotal on the housing between a closed position and an open position and pivotal inward past the closed position, the fork being pivoted into the closed position on inward displacement of the latch element into the housing, the latch fork having an inwardly directed fork face bearing inward against the latch element in the closed position with the latch element in the housing;

a latch pawl pivotal in the housing between a holding position and a freeing position and engageable with the fork in the holding position to retain same in the closed position;

actuating means coupled with the latch pawl for pivoting same into the freeing position out of contact with the fork for releasing same and allowing the door to open;

a blocking member pivotal on the housing about a blocking-member axis, having an outwardly directed blocking face, and displaceable in the housing between a blocking position with the blocking face confronting and relatively closely juxtaposed with the fork face and an unblocking position with the blocking face spaced farther from the fork face, the blocking face being aligned directly between the fork face and the blocking-member axis in the blocking position of the blocking member and closed position of the latch pawl; and link means between the latch pawl and the blocking member for displacing the blocking member into the blocking position and pressing the blocking face outward against the latch element in the closed position of the latch pawl, whereby the latch element is trapped between the faces, and for displacing the blocking member into the unblocking position and out of the path of the latch element when the latch pawl is not in the closed position to permit overtravel of the fork.

2. The motor-vehicle door latch defined in claim 1 wherein the blocking member is a lever having a blocking arm formed with the blocking face and an actuating arm connected via the link means to the latch pawl.

3. The motor-vehicle door latch defined in claim 2 wherein the link means is an arm formed on the latch pawl and engageable with the actuating arm of the blocking member.

4. The motor-vehicle door latch defined in claim 1, further comprising a spring urging the blocking member into the blocking position.

* * * * *